United States Patent [19]

Sewell

[11] Patent Number: 4,977,763

[45] Date of Patent: Dec. 18, 1990

[54] PADLOCK PROTECTOR

[76] Inventor: Hestel D. Sewell, 4525 W. 57th St., North, Wichita, Kans. 67204

[21] Appl. No.: 560,346

[22] Filed: Jul. 30, 1990

[51] Int. Cl.[5] ..... E05B 67/38

[52] U.S. Cl. ..... 70/54; 70/56; 70/417

[58] Field of Search ..... 70/54, 56, 55, 417; 292/148, 205

[56] References Cited

U.S. PATENT DOCUMENTS

| | | | |
|---|---|---|---|
| 4,095,828 | 6/1978 | East | 292/140 |
| 4,852,920 | 8/1989 | DeForrest | 70/50 |
| 4,879,889 | 11/1989 | DeForrest | 70/56 |
| 4,896,518 | 1/1990 | Appelgren | 70/54 |
| 4,911,486 | 3/1990 | Anderson | 70/54 |

*Primary Examiner*—Robert L. Wolfe
*Attorney, Agent, or Firm*—Edward L. Brown, Jr.

[57] ABSTRACT

A padlock protector for use with a padlock in securing both a dead bolt door lock and a hasp and staple latch comprising a thin-walled steel container sized to receive and contain a padlock including a first slot in a side wall of the container sized to receive the staple of a conventional hasp, surrounding the slot is a spacer bracket on the inside of the container for limiting the staple opening depth which receives the padlock shackle and a second slot located at a radius corner of two side walls, sized to receive a dead bolt lock with a lateral shackle engaging hole therein which is engageable by the padlock shackle from within the container.

6 Claims, 2 Drawing Sheets

PADLOCK PROTECTOR

BACKGROUND OF THE INVENTION

This invention relates to a padlock burglar-proof device and more particularly to a surrounding box which protects not only the shackle of the padlock but also the staple of the hasp from burglar tools such as hacksaws, bolt cutters and sledge hammers.

DESCRIPTION OF THE PRIOR ART

Devices for protecting padlocks have been in existence for many years as evidenced by U.S. Pat. No. 1,429,105. Devices which protect the lock shackle is taught in the DeForrest U.S. Pat. No. 4,879,889; the Grille U.S. Pat. No. 4,760,720; the Delgadillo U.S. Pat. No. 3,718,014 and the DeLucia U.S. Pat. No. 4,033,155. Some of the last-mentioned patents are also concerned with protection of the exposed staple as well as the shackle of the lock.

All of the protecting devices disclosed in the patents above are concerned with only conventional hasp and staple type of latching mechanisms and none are concerned with dead bolt locks.

SUMMARY OF THE INVENTION

The present invention provides a padlock protecting device which is usable not only with conventional hasp and staple locking devices but also dead bolt locks which are engaged by a unique slot located on the corner of the protector which allows the protector to extend over only a portion of the bolt carrier. The slot the protector for receipt of conventional hasp and staple is provided with a spacing bracket which not only protects the padlock shackle but also retains the protector flush against the hasp so as to cover the staple from easy engagement by a hacksaw. The protector container of the present invention is fabricated from relatively thin high strength spring steel in a welded construction which resists sledge hammers, hacksaws and bolt cutters by reason of its thickness.

It is therefore the principal object of the present invention to provide a new and improved padlock protective shield which is usable on both dead bolt locks as well as the conventional hasp and staple.

Another object of the present invention is to provide a padlock protective device fabricated from high strength steel of a welded construction which is resistant to hacksaws, bolt cutters, and sledge hammers.

Another object of the present invention is to provide a padlock protecting enclosure which is sized to permit easy insertion of the open padlock through its open end while reversal of the padlock once engaged to access the shackle is not possible.

A further object is to provide a device which is relatively inexpensive to manufacture and highly versatile in use.

Other objects, features and attendant advantages of the present invention will become apparent to those skilled in the art from the reading of the following detailed description of the preferred embodiment constructed in accordance with the accompanying drawings wherein like numerals designate like parts in the several figures and wherein:

DESCRIPTION OF THE PREFERRED EMBODIMENT

Figure 1:
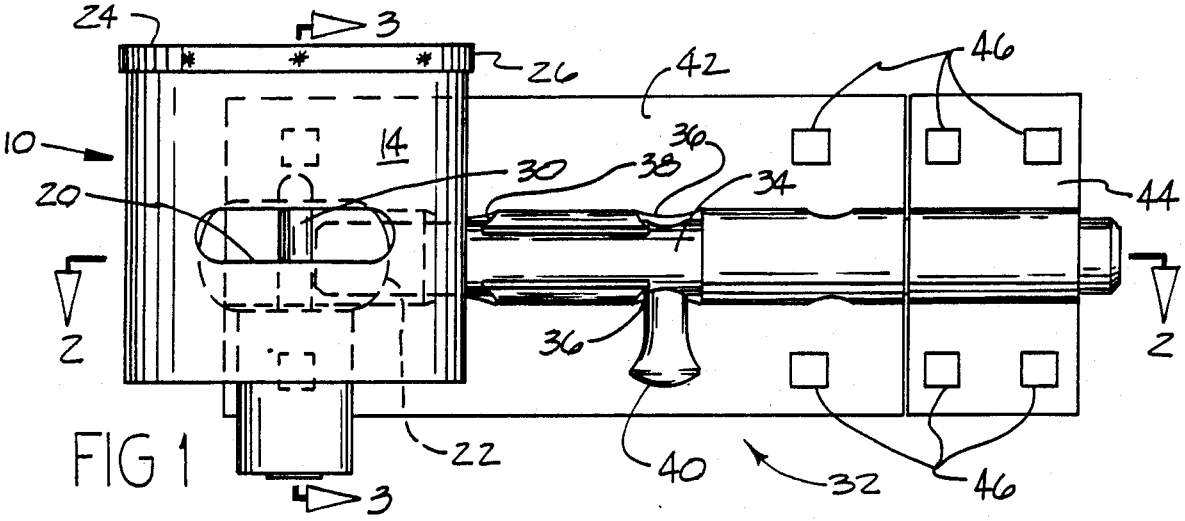
FIG. 1 is a front elevational view of the padlock protector of the present invention utilized on a dead bolt lock.
Figure 2:
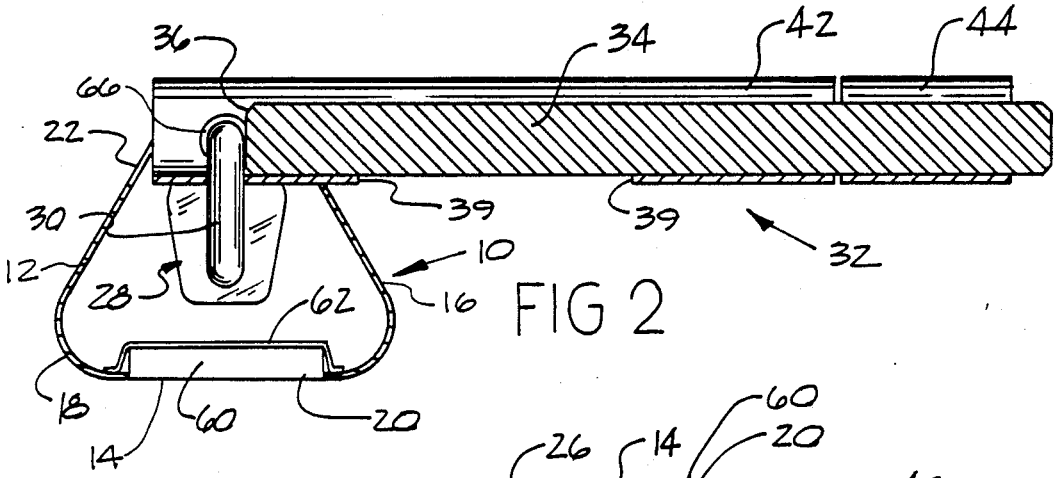
FIG. 2 is a sectional view along line 2—2 of FIG. 1 showing the dead bolt and protector in section.
Figure 3:
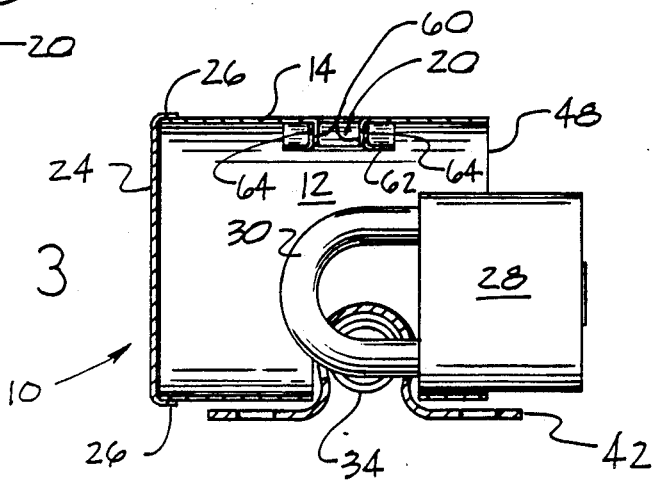
FIG. 3 is a sectional view along line 3—3 of FIG. 1.
Figure 4:
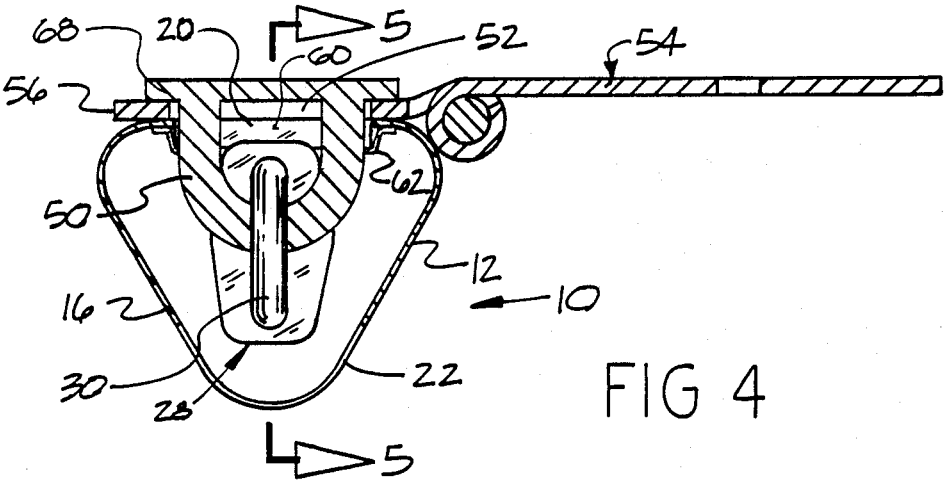
FIG. 4 is a sectional plan view similar to FIG. 2 with the protecting device mounted on a conventional hasp and staple locking device.
Figure 5:
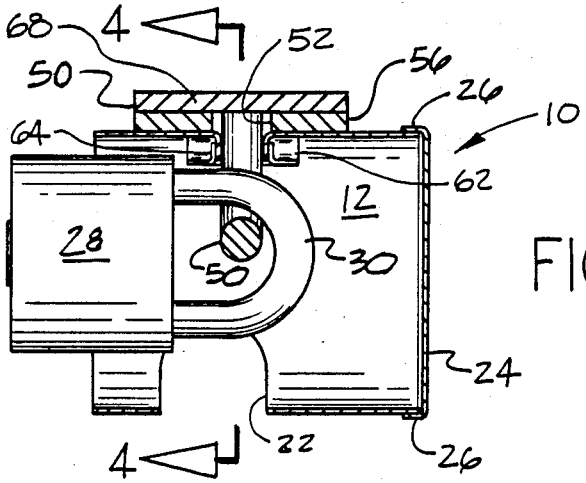
FIG. 5 is a sectional view taken along line 4—4 of FIG. 4.

Referring now to the drawings and more particularly to FIGS. 1 and 2, the padlock protector is generally described by reference numeral 10 which has a generally triangular box shape including planar side walls 12, 14 and 16. The protector 10 has an open bottom 48 while the top is closed by end plate 24 which includes a peripheral flange 26. End plate 24 is spot-welded to the side walls as indicated in FIG. 1. The side walls are fabricated from a single flat sheet with radius corners 18 at each of the three corners and a butt weld down the center of one of the side walls, which is not shown in the drawing. The first engaging slot 20, which is seen in full line in FIG. 1, is formed to snugly receive a conventional staple 50, as illustrated in FIGS. 4 and 5, which will be described in detail hereafter. The second slot 22, which is wider in width and shown in dotted line in FIG. 1, is located at the juncture of side walls 12 and 16 which is best seen in FIGS. 2 and 5. The width of second slot 22 is slightly greater than dead bolt carrier 42, as shown in FIG. 3. Due to the fit of slot 22 on bolt carrier 42, the shackle 30 of the padlock 28 cannot be quickly reached by any type of cutting device.

In viewing FIG. 1, a conventional dead bolt lock 32 is illustrated which includes a sliding bolt 34 which slides in a bolt carrier 42, which is fixed to the door, and a bolt receiver 44 which in turn is attached to the side frame of the door. The bolt carrier 42 and receiver 44 are both shown with square holes 46 therein which are for receipt of mounting bolts, not shown, for attaching the locking mechanism to the door and door frame. The sliding bolt 34 has a handle 40 which when moved horizontal allows the bolt to slide longitudinally into an out-of-engagement with receiver 44. Located in bolt carrier 42 are two lateral slots 36 and 38 which retain the bolt either in its locked or unlocked position. Located at the left end of bolt carrier 42, as illustrated in FIG. 2, are a pair of lateral holes 66 for engagement by the padlock shackle 30. With shackle 30 locked in place, sliding bolt 36 is also locked in place since the opening of the bolt requires movement in the left direction, as seen in FIG. 2. The tolerance fit of the padlock shackle 30 in holes 66 is loose so that the padlock can rotate about its shackle 30. The inside dimensions of protector 10 would allow padlock 28 to rotate 180° from its FIG. 3 position but for the presence of spacer bracket 62 which is spot-welded to the inside of side wall 14. Bracket 62 has a dual function in preventing padlock 28 from rotating as well as providing a spacer means for the staple 50, as described in FIGS. 4 and 5.

FIGS. 4 and 5 illustrate the padlock protector 10 utilized with a conventional hasp type latch. Hasp 54 includes a pivotally mounted latch 56 attached to its left end as illustrated in FIG. 4 with a longitudinal slot 52 located in the center of the latch 56. The stationary portion of the latch is a staple 50 which is a u-shaped bolt attached to base plate 68, as seen in FIG. 4. Staple 50 is engaged by latch 56 as staple 50 passes through slot 52.

Padlock protector 10 includes a similarly-shaped slot 20 which receives staple 50, as seen in FIG. 4. Positioned around slot 20 is a spacer bracket 62 which includes a pair of down turned legs 64 defining slot 20 while the slot 20 cut in side wall 14 also includes a pair of downwardly bent flanges 60, as shown in FIG. 3. Spacer bracket 62 is spot-welded at its ends to the backside of side wall 14, thus providing a spacer which is approximately ⅜ths of an inch in thickness. This spacer limits the depth of the staple opening so that the padlock shackle 30 essentially fills that opening and prevents the protector 10 from being pulled away from the staple a sufficient distance for access of a hacksaw. As previously mentioned, spacer bracker 62 has a secondary function in limiting the rotational movement of padlock 28 within the protector 10.

While the invention has been described with respect to the preferred physical embodiment constructed in accordance herewith, it will be apparent to those skilled in the art that various modifications and improvements may be made without departing from the scope and spirit of the invention. Accordingly, it is to be understood that the invention is not to be limited by the specific illustrated embodiment, but only by the scope of the appended claims.

I claim:

1. A padlock protector for use with a padlock in securing both dead bolt door locks and hasp and staple latches comprising:

a thin-walled container having side walls one closed end and one open end, the container is sized to receive and contain a padlock and shackle through the open end;

a first slot means in a side wall sized to receive the staple of a conventional hasp and staple latch;

spacer means surrounding the first slot and attached to the container for limiting the extension of the staple inside the container for engagement by the padlock shackle; and second slot means in a side wall having a radius, the slot means sized in width to receive a dead bolt door lock with a lateral shackle engaging hole therein which is engageable by the padlock shackle from within the container.

2. A padlock protector as set forth in claim 2, wherein the container has at least three planar walls each joined by a radius corner.

3. A padlock shackle and staple protector as set forth in claim 1, wherein the container has at least three planar walls each joined by a radius corner, the first slot means is positioned in one of said planar walls and the second slot means is positioned in a radius corner between two of said planar walls.

4. A padlock shackle and staple protector as set forth in claim 2, wherein the spacer means is a u-shaped bracket with a similar slot therein spaced from the adjacent side wall to provide close tolerance between the protector and staple to prevent exposure of the staple to a cutting means.

5. A padlock shackle and staple protector as set forth in claim 2, wherein the open end container is sized to receive the padlock shackle within the staple or dead bolt lateral engaging hole but small enough to prevent the padlock in its locked position from rotating sufficiently to expose the shackle from said open end.

6. A padlock shackle and staple protector as set forth in claim 2, wherein the container is fabricated in a triangular shaped box with radius corners from high strength steel with the closed end having a flange there around which is spot welded to the side walls.

* * * * *